United States Patent [19]

Strauss et al.

[11] Patent Number: 5,033,276

[45] Date of Patent: Jul. 23, 1991

[54] TRIPLE VARIATION KNIT FABRIC

[75] Inventors: Isidore Strauss, Clark, N.J.; Sam A. Rankin, Jr., Ashboro, N.C.

[73] Assignee: Miller Harness Company, Inc., East Rutherford, N.J.

[21] Appl. No.: 452,790

[22] Filed: Dec. 19, 1989

[51] Int. Cl.[5] ..... D04B 1/14

[52] U.S. Cl. ..... 66/196

[58] Field of Search ..... 66/196, 197

[56] References Cited

U.S. PATENT DOCUMENTS

| | | | |
|---|---|---|---|
| 853,667 | 5/1907 | Williams | 66/196 |
| 3,234,724 | 2/1966 | Storti | 57/225 |
| 3,309,863 | 3/1967 | Hermes | 57/225 X |
| 3,315,328 | 4/1967 | Ibrahim | 57/225 X |
| 4,062,204 | 12/1977 | Segundo et al. | 66/196 |

FOREIGN PATENT DOCUMENTS

| | | | |
|---|---|---|---|
| 2713539 | 9/1978 | Fed. Rep. of Germany | 66/197 |
| 59-168154 | 9/1984 | Japan | 66/196 |
| 7508671 | 1/1976 | Netherlands | 66/196 |
| 629257 | 10/1978 | U.S.S.R. | 66/197 |
| 370761 | 4/1932 | United Kingdom | 66/202 |
| 411269 | 6/1934 | United Kingdom . | |
| 460601 | 2/1937 | United Kingdom . | |
| 916991 | 1/1963 | United Kingdom . | |
| 1355351 | 6/1974 | United Kingdom | 66/196 |

OTHER PUBLICATIONS

Textured Yarn Technology, vol. I, G. D. Wilkinson Monsanto Co., 1967, pp. 351 through 361.

Reichman, "Knitting Encyclopedia", 1972, Knitted Outerwear Assoc., pp. 261 through 262.

Translation of Russian Document No. 629,257, USPTO, Jan. 1990.

*Primary Examiner*—Werner H. Schroeder

*Assistant Examiner*—John J. Calvert

*Attorney, Agent, or Firm*—Lerner, David, Littenberg, Krumholz & Mentlik

[57] ABSTRACT

A knitted fabric for recreational clothing which has a first yarn on both the first side and the second side of the fabric and a second yarn on only the first side of the fabric, the yarns having been knit by a repeat knitting process on a double-knitting machine where the second yarn is knit only on the dial needles and the first yarn is knit on both the dial needles and the cylinder needles so as to provide the knitted fabric with a high degree of strength and recovery. The second yarn is comfortable against one's skin while facilitating with the first yarn the provision of the desirable strength and recovery characteristics.

8 Claims, 3 Drawing Sheets

TRIPLE VARIATION KNIT FABRIC

BACKGROUND OF THE INVENTION

The present invention relates generally to fabrics for clothing, and more particularly to fabrics for recreational clothing in which the strength and the degree of recovery at least partially define the quality of the fabric.

Some fabrics for recreational clothing have used a double-knit stitch known as the triple knit. This stitch, usually used to knit nylon or yarns having properties similar to nylon, provides a high degree of strength for fabrics which are to be used for the production of recreational clothing such as riding pants for jockeys. The triple knit structure is knit on a conventional double-knit machine in which the dial needles are arranged radially in the slots of the needle bed and operate horizontally to make the inside of a fabric tube, and the cylinder needles are arranged parallel to one another and operate vertically to make the outside of a fabric tube. Yarns and/or threads which are to make up a particular fabric are fed to the double-knit machine in a plurality of feeds, each feed passing through the needle bed so that selected dial needles and cylinder needles perform the desired knitting function. Each needle is of a conventional type, having a hook and a loop. In a knitting path, the needle raises up so that the old loop goes below the latch of the needle. New yarn is taken into the hook and old loop closes the latch and a new stitch is formed. The number of needles in a double-knit machine varies. For instance, in some cases 1,800 needles are used for a 36 feed knitting process.

In triple knit, every third needle is knit in sequence at each of three feeds. Thus, the triple knit is a three feed repeat and three needle repeat knitting sequence. FIG. 1 shows, in schematic, six feeds being knit on six needles, it being understood that this sequence repeats through all of the feeds and needles in the knitting operation. Thus, the dial needles (even numbered) and the cylinder needles (odd-numbered) are shown for each feed. The designation "A" represents nylon yarn.

More particularly, it can be seen that the triple knit structure is obtained by the following sequence. At feed 1, the nylon yarn is knit on the dial needles at every third dial needle starting with dial needle 4, and is knit on the cylinder needles at every third cylinder needle starting with cylinder needle 1. At feed 2, the nylon yarn is knit on the dial needles at every third dial needle starting with dial needle 6, and knit on the cylinder needle at every third cylinder needle starting with cylinder needle 3. At feed 3, the nylon yarn is knit on the dial needles every third dial needle starting with needle 2, and knit on the cylinder needles at every third needle starting with needle 5. This sequence is then repeated to produce the fabric in as many feeds as is necessary, the feeds and knitting facilitating the formation of "courses" in the fabric being formed.

The knitted structure of the triple knit fabric provides a relatively small degree of stretch in any direction, though it does provide some degree of recovery or "power" (as it is sometimes called in the industry). Recovery is simply the ability of the knit structure, in conjunction with the yarns with which the fabric is knit, to regain its configuration after having been stretched. This is important to one participating in recreational activities as it enables the participant to manipulate the apparel made from a fabric having good recovery.

However, even though the triple knit structure has some degree of recovery, it is useful mostly because of the strength it imparts to fabrics made thereby. Further, in the past, this triple knit structure has been knit only with stretch nylon, which is not particularly comfortable against the skin. Thus, for a participant in a recreational activity, a piece of apparel made of nylon and knit with the triple knit structure will be quite uncomfortable, and provide less recovery than is desired for recreational clothing.

It should be noted that the triple knit structure does not lend itself to providing one type of yarn on one side of the fabric and another yarn or mix of yarns on the other side of the fabric. The result of knitting two different yarns on the triple knit would be a mix of these yarns on either side of the fabric formed thereby. This is apparent from the schematic representation of the triple knit structure in FIG. 1.

It is thus apparent that a new knit structure is warranted to provide more comfort against the skin and a higher degree of recovery, all while maintaining the strength of the fabric. The inventors herein have established such a new knit structure which is based, in part, on a modification of the triple knit structure.

SUMMARY OF THE INVENTION

The present invention specifically relates to a knitted fabric for recreational clothing and a method of producing the same. The knitted fabric in accordance with the present invention includes a first yarn on a first side of the fabric and a second yarn on the first side and a second side of the fabric. In the preferred embodiment, the first yarn and the second yarn are knit together by a 12-feed repeat process on a double-knitting machine having a plurality of dial needles for the formation of the second side of the fabric and a plurality of cylinder needles for the formation of the first side of the fabric. At feed 1 of the 12-feed repeat process, the second yarn is fed and knit at every third dial needle starting at dial needle 4. At feed 2, the first yarn is fed and knit at every third cylinder needle starting at cylinder needle 1. At feed 3, the first yarn is knit at every third cylinder needle starting at cylinder needle 3 and at every third dial needle starting at dial needle 6. At feed 4, the first yarn is knit at every third dial needle starting at dial needle 2 and at every third cylinder needle starting at cylinder needle 5. At feed 5, the first yarn is knit at every third cylinder needle starting at cylinder needle 1 and at every third dial needle starting at dial needle 4. At feed 6, the second yarn is knit at every third dial needle starting at dial needle 6. At feed 7, the first yarn is knit on every third cylinder needle starting at cylinder needle 3. At feed 8, the first yarn is knit at every third dial needle starting at dial needle 2 and at every third cylinder needle starting at cylinder needle 5. At feed 9, the first yarn is knit at every third cylinder needle starting at cylinder needle 1 and at every third dial needle starting at dial needle 4. At feed 10, the first yarn is knit at every third cylinder needle starting at cylinder needle 3 and at every third dial needle starting at dial needle 6. At feed 11, the second yarn is knit at every third dial needle starting at dial needle 2. Finally, at feed 12, the first yarn is knit at every third cylinder needle starting at cylinder needle 5. These feeds are then repeated until the desired amount of fabric is produced.

While the foregoing sequence of knitting represents the optimum sequence for producing the fabric in accordance with the present invention, the number of feeds could be reduced while still providing a fabric having a sufficiently high degree of recovery and high degree of strength for recreational clothing. The only sacrifice would be that the fabric produced would not be as smooth or aesthetically pleasing as the fabric knit by the 12-feed process. Accordingly, it has been found that the minimum number of feeds which can be employed in connection with the knitting sequence of the present invention to provide a commercially viable fabric is 4. That is, the fabric in accordance with the present invention can be produced by repeating only the first four feeds of the above-described knitting sequence. Of course, this sequence is repeated until the desired amount of fabric is produced.

In accordance with the objects underlying the present invention, the second yarn should be one which would be comfortable next to one's skin. To further other objects of the present invention, a corespun yarn (cotton covered LYCRA) is employed as the second yarn, the first yarn being nylon. These particular yarns are only representative as other suitable yarns similar to these can be employed.

Accordingly, it is an object of the present invention to provide a knit structure useful for making recreational clothing, wherein the knit structure provides a high degree of strength and a high degree of recovery.

It is another object of the present invention to provide a knit structure as described in the preceding paragraph, which includes two types of yarn to enhance the strength and recovery of the knit structure, and to provide comfort against the skin.

BRIEF DESCRIPTION OF THE DRAWINGS

The foregoing and other objects of the present invention will become apparent, as will a better understanding of the concepts underlying the present invention, by reference to the description which follows and refers to the accompanying drawings in which.

DETAILED DESCRIPTION

Figure 1:
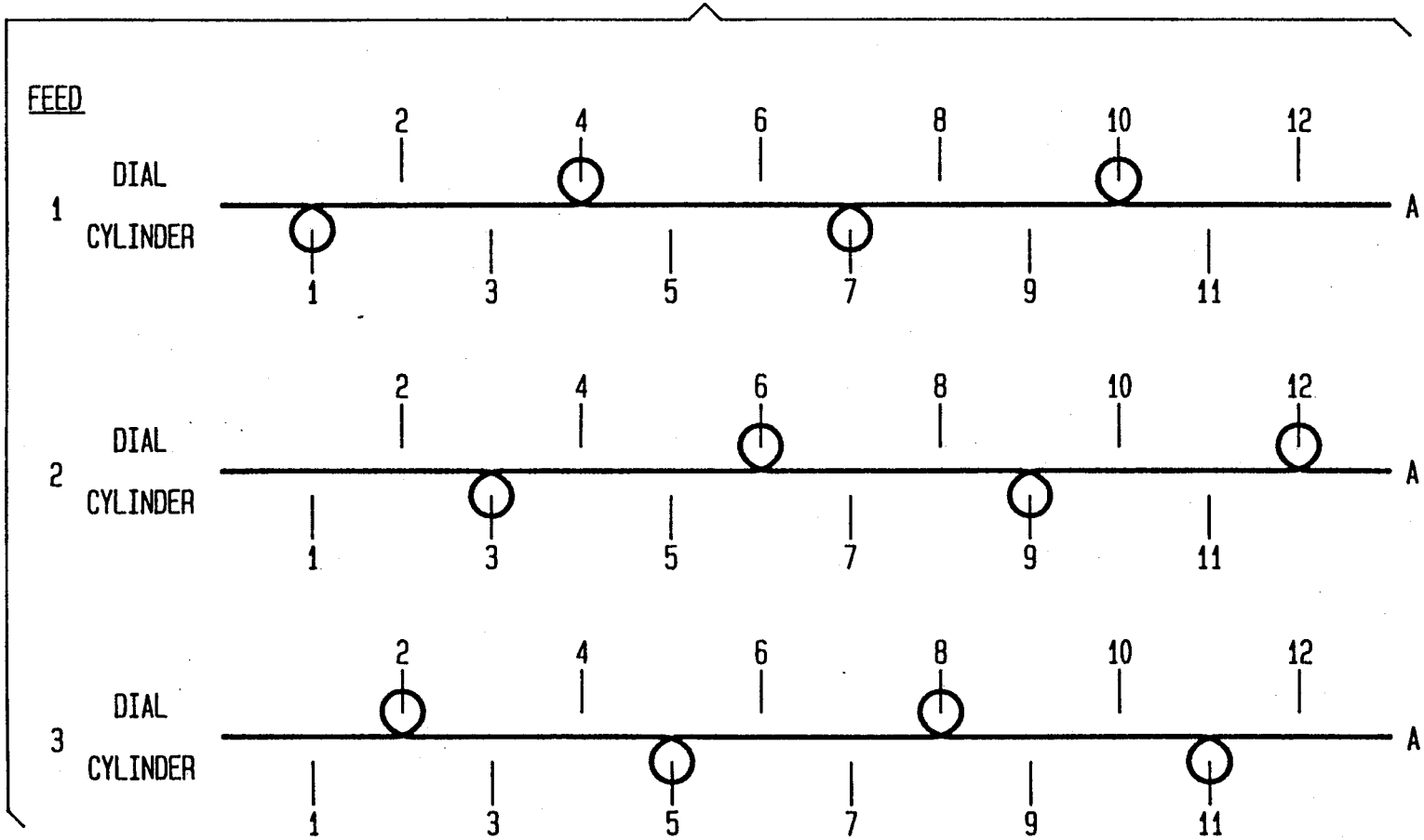
FIG. 1 (PRIOR ART)
FIG. 1 is a schematic representation of the conventional method for the knitting of a conventional triple knit structure.
Figure 2:
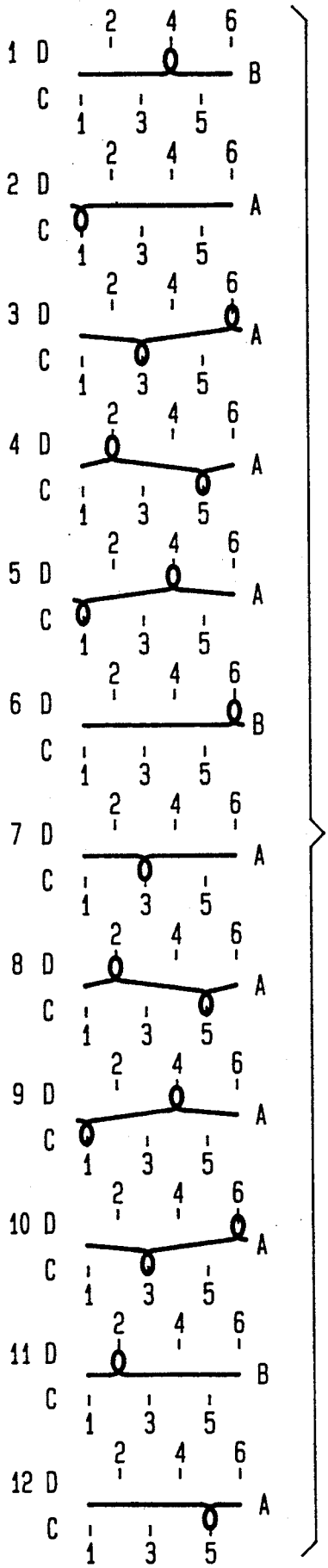
FIG. 2 is a schematic representation of the process for knitting the triple variation knit fabric in accordance with the present invention.
Figure 3:
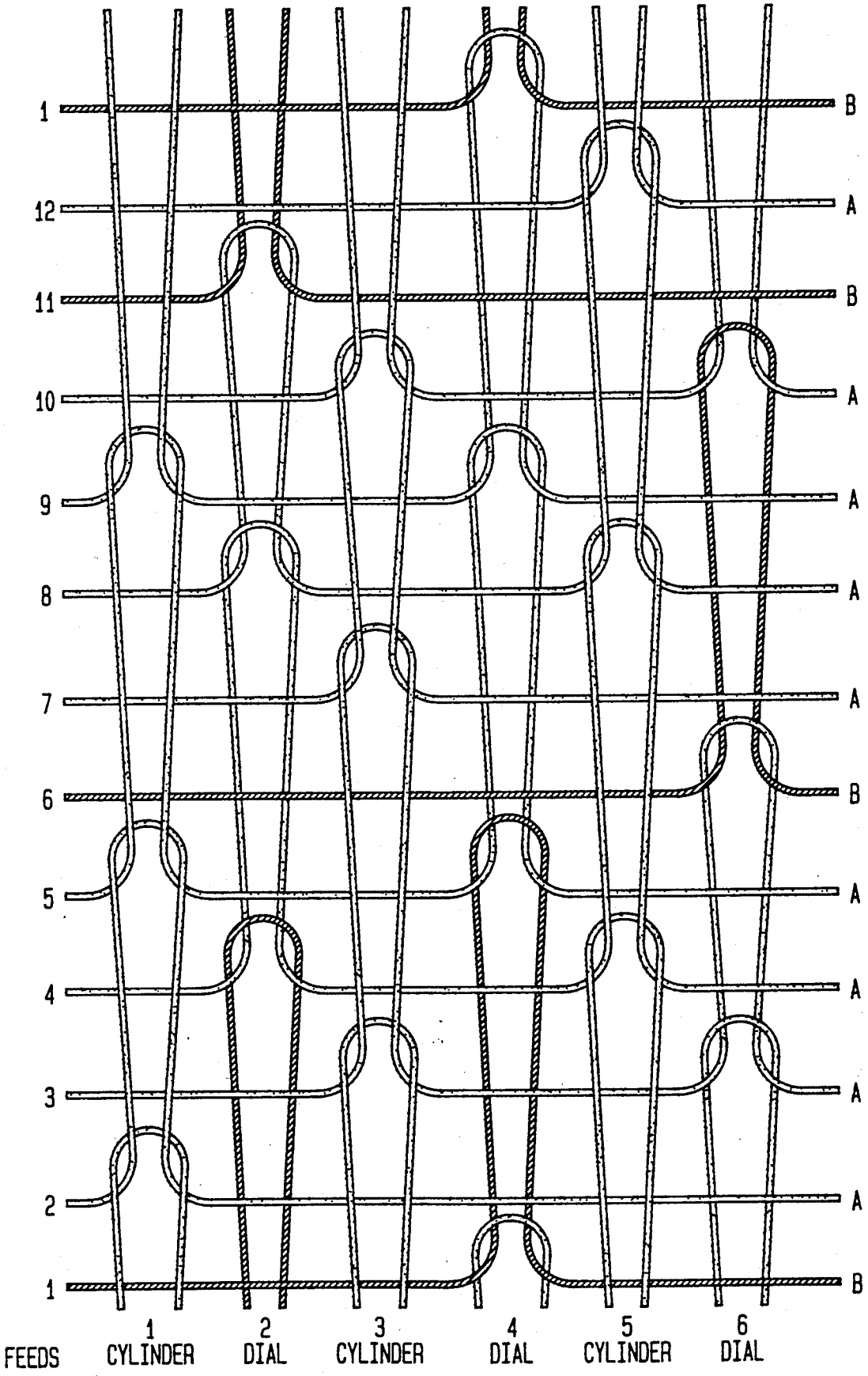
FIG. 3 is a schematic view of a knit structure made in accordance with the present invention, the knit structure being illustrated in loose configuration, i.e., prior to the tightening of the yarns.

Referring to the figures, FIG. 1 illustrates a conventional stitch, and FIGS. 2 and 3 illustrate the stitch in accordance with the present invention, FIG. 2 being diagrammatic, and FIG. 3 being the knit structure itself.

Thus, as discussed above, FIG. 1 shows, diagrammatically, three feeds of the triple knit stitch in which the odd numbered needles are cylinder needles and the even numbered needles are dial needles. The loops represent a knit—that is, where the needle raises up so that new yarn is taken into the hook of the needle to facilitate the formation of a new stitch. The straight lines represent welt paths—that is, where the needle passes through the stitch forming area without taking on any new yarn. The yarn A on each feed is 100% nylon, or more specifically, 2/70/17 stretch nylon. This designates a nylon made up of two plies of 70 denier 17 filament nylon. It can be seen that this conventional stitch has been named "triple knit" because it is a three-feed repeat process wherein the knitting occurs on every third needle on both the dial and cylinder needles.

The stitch of the present invention is based in part on the triple knit stitch. Although the stitch of the present invention can be considered a variation of the triple knit stitch, there is little resemblance between the knitted structures because of the alterations which had to be made to the stitch of the present invention to provide the desirable properties as discussed above.

Accordingly, FIG. 2 shows a diagrammatic representation of the stitch in accordance with the present invention. Again, the odd numbered needles represent the cylinder needles, while the even numbered needles represent the dial needles, and the loops and straight lines represent knits and welt paths. It can also be seen that the stitch of the present invention is preferably a 12-feed repeat, 3-needle repeat stitch, as opposed to a 3-feed repeat. Essentially, it has been found that this 12-feed repeat knitting sequence provided a fabric which is smooth and aesthetically pleasing, and therefore commercially acceptable for high quality fabrics for recreational clothing. If a lesser number of feeds were employed utilizing the knitting sequence in accordance with the present invention, the desirable properties of strength and recovery might be obtained; however, the fabric might be somewhat less aesthetic as it might have a slight bumpy or nubbly appearance. Although such a fabric would be of less quality than a fabric knit by a 12-feed repeat process utilizing the knitting sequence of the present invention, it is nevertheless considered to be of better quality than prior art fabrics. Indeed, a 4-feed process utilizing the knitting sequence of the present invention would provide a fabric which might be commercially acceptable for use in certain pieces of recreational clothing. This would be the minimum amount of feeds which could be used in connection with the knitting sequence of the present invention to produce the inventive fabric. One of the reasons for this is that for every knit on a cylinder wale, there is a knit on a dial wale. This helps provide a smoother and more aesthetically pleasing fabric, though it is less smooth and less aesthetically pleasing than a fabric knit by the 12-feed process.

Thus, referring to both FIGS. 2 and 3, it is seen that the corespun yarn B is fed into the needle bed of a double knit machine on the first feed, and is knit on every third dial needle starting with dial needle 4. The corespun yarn B takes on a welt path on all other needles. In connection with the 12-feed repeat process shown in these figures, the corespun yarn B is also fed at feed 6, whereby it is knit on every third dial needle starting with dial needle 6; and at feed 11 where it is knit on every third dial starting at dial needle 2. Nylon yarn A, preferably 2/70/17 stretch nylon, is fed at every other feed. In connection with the knitting sequence of the present invention in which there are less than 12 feeds, for instance, 4 feeds, the remaining feeds shown in FIGS. 2 and 3 can merely be disregarded. Thus, in the case of the 4-feed repeat, those feeds shown in the first 4 feeds would be repeated until the desired amount of fabric is produced.

The corespun yarn B utilized in producing the fabric of the present invention comprises a core of a resilient continuous filament yarn and a fiber outer covering the core. Preferably, the fiber outer is cotton or any other similar yarn, typically a natural fiber, which is comfortable against one's skin. The resilient continuous filament yarn can be LYCRA or any other similar yarn which will aid in providing more recovery and the requisite amount of strength and stretch to the fabric in accordance with the present invention.

It should be noted that the corespun yarn B is fed and knit only on the dial needles of the double-knitting machine; while the nylon yarn A is fed and knit on both the cylinder and dial needles. The result is a fabric in which its back comprises both nylon and corespun, while its face comprises only nylon. Further, because there are two stitches of nylon for every one stitch of corespun, the resulting fabric is $\frac{2}{3}$ nylon and $\frac{1}{3}$ corespun.

In order to obtain a smoother and more aesthetically pleasing fabric, there is a cylinder stitch for each dial stitch somewhere within the 12-feed, 4-feed, or other repeat process. The more the knitting sequence varies from having a dial stitch for every cylinder stitch, the bumpier the resulting fabric will be. For some applications, however, a slightly bumpy appearance is acceptable. The 12-feed repeat was chosen as the optimum for the knitting sequence since it not only provided for a dial stitch for every cylinder stitch, but also for a more even distribution of the corespun yarn.

The above-described fabric and method for producing such fabric provides not only comfort against one's skin, but also possesses the desirable properties of strength and recovery which are so important to the production of recreational clothes.

While the foregoing description and figures illustrate the preferred embodiment of the fabric in accordance with the present invention, it should be appreciated that certain modifications can be made and are encouraged to be made in the materials, method and structure of the disclosed embodiments without departing from the spirit and scope of the present invention which is intended to be captured by the claims set forth below.

What is claimed is:

1. A knitted fabric for recreational clothing, said knitted fabric comprising, a first yarn and a second yarn, said yarns having been knit by a 12-feed repeat process on a double-knitting machine having at least sequentially disposed dial needles two, four and six for the formation of the second side of said fabric and at least sequentially disposed cylinder needles one, three, five and seven for the formation of the first side of said fabric, the knitting opf said first and second yarns by said 12-feed repeat process on said double-knitting machine having been accomplished as follows:

a. at the first feed, feed a length of said second yarn and knit that length of said second yarn at every third dial needle starting at dial needle four;

b. at the second feed, feed a length of said first yarn and knit that length of said first yarn at every third cylinder needle starting at cylinder needle one;

c. at the third feed, feed a length of said first yarn and knit that length of said first yarn at every third cylinder needle starting at cylinder needle three, and knit that length of said first yarn at every third dial needle starting at dial needle six;

d. at the fourth feed, feed a length of said first yarn and knit that length of said first yarn at every third dial needle starting at dial needle two, and knit that length of said first yarn at every third cylinder needle starting at cylinder needle five;

e. at the fifth feed, feed a length of said first yarn and knit that length of said first yarn at every third cylinder needle starting at cylinder needle one, and knit that length of said first yarn at every third dial needle starting at dial needle four;

f. at the sixth feed, feed a length of said second yarn and knit that length of said second yarn at every third dial needle starting at dial needle six;

g. at the seventh feed, feed a length of said first yarn and knit that length of said first yarn on every third cylinderneedle starting at cylinder needle three;

h. at the eighth feed, feed a length of said first yarn and knit that length of said first yarn at every third dial needle starting at dial needle two, and knit that length of said first yarn at every third cylinder needle starting at cylinder needle five;

i. at the ninth feed, feed a length of said first yarn and knit that length of said first yarn at every third cylinder needle starting at cylinder needle one, and knit that length of said first yarn at every third dial needle starting at dial needle four;

j. at the tenth feed, feed a length of said first yarn and knit that length of said first yarn at every third cylinder needle starting at cylinder needle three, and knit that length of said first yarn at every third dial needle starting at dial needle six;

k. at the eleventh feed, feed a length of said second yarn and knit that length of said second yarn at every third dial needle starting at dial needle two; and l. at the twelfth feed, feed a length of said first yarn and knit that length of said first yarn at every third cylinder needle starting at cylinder needle five, the above 12 feeds being repeated until the desired amount of said fabric is produced, thereby providing said first yarn on both the first side and the second side of said fabric, and said second yarn on only the second side of said fabric.

2. The knitted fabric in claim 1, wherein said second yarn is a corespun yarn comprising a core of a resilient continuous filament yarn, and a fiber outer to cover the core so that the core is not exposed.

3. The knitted fabric in claim 2, wherein said first yarn is nylon.

4. The knitted fabric in claim 3, wherein said resilient continuous filament yarn is LYCRA and said fiber outer is cotton.

5. A knitted fabric for recreational clothing, said knitting fabric comprising, a first yarn and a second yarn, said yarns having been knit by a 4-feed repeat process on a double-knitted machine having at least sequentially disposed dial needles two, four and six for the formation of the second side of said fabric and at least sequentially disposed cylinder needles one, three, five and seven for the formation for the first side of said fabric, the knitting of said first and second yarns by said 4-feed repeat process on said double-knitting machine having been accomplished as follows:

a. at the first feed, feed a length of the second yarn and knit that length of the second yarn at every third dial needle starting at dial needle four;

b. at the second feed, feed a length of said first yarn and knit that length of said first yarn at every third cylinder needle starting at cylinder needle one;

c. at the third feed, feed a length of said first yarn and knit that length of said first yarn at every third cylinder needle starting at cylinder needle three, and knit that length of said first yarn at every third dial needle starting at dial needle six; and d. at the fourth feed, feed a length of said first yarn and knit that length of said first yarn at every third dial needle starting at dial needle two, and knit that length of said first yarn at every third cylinder needle starting at cylinder needle five, the above 4 feeds being repeated until the desired amount of said fabric is produced, whereby said first yarn is on both the first side and the second side of said fabric, and said second yarn is only ion the second side of said fabric.

6. The knitted fabric in claim 5, wherein said second yarn is a corespun yarn comprising a core of a resilient continuous filament yarn and a fiber outer to cover the core so that the core is not exposed.

7. The knitted fabric in claim 6, wherein said first yarn is nylon.

8. The knitted fabric in claim 7, wherein said resilient continuous filament yarn is LYCRA and said fiber outer is cotton.

* * * * *